United States Patent [19]

Goffe et al.

[11] 3,933,491

[45] Jan. 20, 1976

[54] IMAGING SYSTEM

[75] Inventors: William L. Goffe, Webster; Joseph Mammino, Penfield, both of N.Y.

[73] Assignee: Xerox Corporation, Stamford, Conn.

[22] Filed: Sept. 20, 1971

[21] Appl. No.: 181,990

Related U.S. Application Data

[63] Continuation-in-part of Ser. No. 837,592, June 30, 1969, abandoned, which is a continuation-in-part of Ser. No. 553,837, May 31, 1966, abandoned, and a continuation-in-part of Ser. No. 837,591, June 30, 1969, abandoned.

[52] U.S. Cl. ..... 96/1.5; 96/1 PS

[51] Int. Cl.[2] ..... G03G 5/04

[58] Field of Search ..... 96/1.5–1.8, 96/1 PS; 117/201, 215, 218, 72; 204/2, 181; 178/6.6 TP

[56] References Cited

UNITED STATES PATENTS

| | | | |
|---|---|---|---|
| 2,798,821 | 7/1957 | Lehmann | 117/21 |
| 2,860,048 | 11/1958 | Deubner | 96/1.5 |
| 2,886,434 | 5/1959 | Owens | 96/1.5 |
| 3,238,041 | 3/1966 | Corrsin | 96/1.1 |
| 3,254,997 | 6/1966 | Schaffert | 96/1 R |
| 3,276,031 | 9/1966 | Gaynor | 96/1.1 |
| 3,291,600 | 12/1966 | Nicole | 96/1.5 X |
| 3,408,181 | 10/1968 | Mammino | 96/1.1 |
| 3,450,831 | 6/1969 | Gaynor | 178/6.6 |

OTHER PUBLICATIONS

Kearns, D. R., "Electrical Properties of Organic Solids," (Thesis), Lawrence Radiation Laboratory, University of California, Berkeley, California, Contract No. W-7405-eng-48 (Mar. 25, 1960).

*Primary Examiner*—Charles E. Van Horn

[57] ABSTRACT

An imaging system using a migration imaging member comprising a softenable photoconductive material with a fracturable layer of migration marking material contacting the softenable photoconductive material and having the fracturable layer spaced apart from at least one surface of the softenable layer and typically contiguous to the free surface of the softenable material. Imaging with a member comprising a softenable photoconductive binder material with marking particles therein dispersed throughout said softenable binder is also disclosed. Imaging is accomplished by providing a migration force across the migration imaging member and developing the member whereby the migration marking material migrates in depth in the softenable layer in imagewise configuration.

1 Claim, 6 Drawing Figures

INVENTORS.
WILLIAM L. GOFFE
JOSEPH MAMMINO

BY David C. Petre

IMAGING SYSTEM

CROSS-REFERENCES TO RELATED APPLICATIONS

This application is a continuation-in-part of the inventors' copending application Ser. No. 837,592, filed June 30, 1969, now abandoned (which is a continuation-in-part of Ser. No. 553,837, filed May 31, 1966, and now abandoned) and as to common matter in Ser. No. 837,591 which was invented by William L. Goffe and Joseph Mammino is a continuation-in-part of copending application Ser. No. 837,591, filed June 30, 1969 (which as to common matter in Ser. No. 837,591 which was invented by William L. Goffe and Joseph Mammino is a continuation-in-part of Ser. No. 553,837, filed May 31, 1966, and now abandoned).

BACKGROUND OF THE INVENTION

This invention relates in general to imaging systems, and, more specifically, concerns an improved migration imaging system.

There has been recently developed a migration imaging system capable of producing images of high quality and excellent resolution. This system is described in detail and claimed in application Ser. No. 403,002, filed Oct. 12, 1964, now abandoned. In a typical embodiment of this imaging system, a layer of a softenable material is coated onto a substrate and a fracturable photoconductive layer is formed contiguous to the surface of the softenable layer, thereby forming an imaging member. The fracturable marking material may also be particulate and the softenable layer which may be soluble in a solvent which does not attack the fracturable layer. An electrostatic latent image is formed on the surface of the fracturable layer, or the member is uniformly electrostatically charged and exposed to a pattern of activating electromagnetic radiation, and then the softenable layer is softened, for example by dipping the plate in a solvent. Portions of the fracturable layer migrate in imagewise configuration through the softenable layer as it is softened or dissolved, leaving an image on the substrate conforming to a negative or positive of the original (depending upon the imaging materials and processing variations used). Those portions of the fracturable layer which do not migrate to the substrate, and the softenable layer may be washed away with a solvent for the softenable layer. The image resulting is of high quality and of especially high resolution. Alternative embodiments are further described in the above cited copending applications.

Another variation of migration imaging for example as described in copending application Ser. No. 483,675, filed Aug. 30, 1965, now U.S. Pat. No. 3,656,990, may use non-photoconductive particles coated over a non-photoconductive soluble layer on a substrate. Here, an electrostatic latent image is formed as by corona charging through a stencil. When the imaging member is exposed to a solvent for the softenable layer, particles migrate to the substrate in imagewise configuration. Undesirable particles are washed away with the soluble layer. While this imaging process does not require but may use photoconductive materials, the charge pattern is typically applied in imagewise configuration, e.g., by corona charging through a stencil.

Each of these imaging systems is capable of producing excellent images. However, each system has its own inherent advantages. The first system described above requires that the fracturable layer comprise an electrically photosensitive and typically a photoconductive material. Ordinarily this layer is in the form of particles. Some of the photoconductors produce more desirable images than others. Often, the color of the photoconductive particles is other than black so that the final image produced is other than black-on-white. Typical useful photoconductors in this system include dark red selenium, and blue-green phthalocyanine.

In the second system described above the electrostatic latent image typically must be originally formed in imagewise configuration. Such images are typically produced from a stencil or similar means.

In new and growing areas of technology such as migration imaging systems, new methods, apparatus, compositions and articles of manufacture are often discovered for the application of the new technology in a new mode. The present invention relates to a new and advantageous migration imaging system using photoconductive softenable materials.

SUMMARY OF THE INVENTION

It is, therefore, an object of this invention to provide an imaging system which overcomes the above noted disadvantages and satisfies the above noted needs.

It is another object of this invention to provide a novel imaging system.

It is another object of this invention to provide a novel migration imaging system.

It is another object of this invention to provide a migration imaging system capable of producing images of high density and high resolution.

It is another object of this invention to provide a migration imaging system wherein images are formed from a wide range of non-photoconductive migration materials.

It is yet another object of this invention to provide a migration imaging system wherein high quality migration images are produced from members comprising both photoconductive and non-photoconductive materials.

It is still another object of this invention to provide an imaging system capable of producing images suitable for various applications such as microfilm, hard copy, optical mask, and others.

It is still another object of this invention to provide a substantially dry vapor developed imaging system.

The foregoing objects and others are accomplished in accordance with this invention by providing a novel migration imaging system utilizing a migration imaging member comprising a softenable photoconductive material containing migration marking material. In one embodiment the softenable photoconductive material has a fracturable layer of migration marking material contacting the softenable photoconductive material wherein said fracturable layer is spaced apart from at least one surface of the softenable layer and typically contiguous to the free surface of the softenable material. In another embodiment the migration marking material typically particles is dispersed throughout the softenable photoconductive material. Fundamentally, the migration imaging system of this invention preferably comprises forming an electrostatic latent image on the surface of the above-mentioned members (preferably uniformly electrostatically charging the surface of said member and exposing said surface to a pattern of activating electromagnetic radiation), softening said softenable layer (as by heat, vapor or treatment with a solvent for said layer or combinations thereof) whereby portions of said migration marking material migrate toward the substrate and may be fixed to said substrate. Optionally especially in the fracturable layer embodiment the softenable layer and unmigrated portions of the fracturable layer may be removed leaving an image corresponding to the original on the substrate. It has been found that freshly prepared plates generally produce positive images, while well aged (several days) plates generally produce negative images. Plates which have been aged for an intermediate period produce images, positive or negative, but of somewhat lower quality than fresh or well aged plates. It is not understood why this image reversal occurs. However, optimum times between plate coating and imaging may be easily determined for particular materials, to produce either excellent positive or negative images.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

Figure 1:
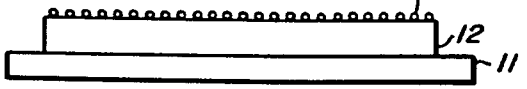
FIG. 1 is a partially schematic cross-sectional illustration of a migration imaging member before imaging.

Referring now to FIG. 1, there is shown a schematic cross-sectional drawing of a preferred embodiment of the migration imaging member of this invention, said member comprising substrate 11, photoconductive softenable layer 12, and fracturable layer 13 of migration marking material.

Substrate 11 may be electrically conductive or insulating. Conductive substrates generally facilitate the charging or sensitization of the member and typically may be of copper, brass, nickel, zinc, chromium, stainless steel, conductive plastics and rubbers, aluminum, steel, cadmium, silver, gold, or paper rendered conductive by the inclusion of a suitable chemical therein or through conditioning in a humid atmosphere to ensure the presence therein of sufficient water content to render the material conductive.

The substrate may be in any suitable form such as a metallic strip, sheet, plate, coil, cylinder, drum, disc, endless belt, moebius strip or the like. If desired, the conductive substrate may be coated on an insulator such as paper, glass or plastic. Examples of this type of substrate are a substantially transparent tin oxide coated glass available under the trademark NESA from Pittsburgh Plate Glass Co., aluminized polyester film the polyester film available under the trademark Mylar from DuPont, or Mylar coated with copper iodide.

Electrically insulating substrates may also be used, which opens up a wide variety of film formable materials such as plastics for use as substrate 11.

Coated over the surface of substrate 11, is a photoconductive softenable layer 12 typically comprising an organic photoconductive material. "Softenable" as used herein to describe layer 12 is intended to mean any material which can be rendered more permeable to particles migrating through its bulk. Conventionally changing permeability is accomplished by softening.

The softenable photoconductive layer may be of any suitable thickness, with thicker layers generally requiring a greater electrostatic potential than the optimum and preferred modes of this invention. Thicknesses from about ½ to about 16 microns have been found to be preferred, but a uniform thickness over the imaging area from about 1 to 4 microns is found to provide high quality images while facilitating image member construction.

The softenable layer 12 may be coated directly onto the conductive substrate, or alternatively, the softenable layer may be self-supporting. Such self-supporting imaging members may themselves be imaged by processes involving selectively softening only portions of the area or thickness of the softenable material while the unsoftened portions thereof maintain sufficient integrity to continue to support the member. Typically, however, the self-supporting softenable layered member is brought into contact with a suitable substrate before or during the imaging process.

The softenable layer may comprise any photoconductive material which is capable of being softened so as to permit particles from the surface layer to migrate towards or to the substrate during image formation. While the layer may be softened for example by heat, solvents, or solvent vapors or combinations thereof, it is preferable that the softening be accomplished by a solvent which does not attack the fracturable layer 13 but which removes the softenable layer 12 and unwanted portions of the fracturable layer, leaving only those particles forming the image on the plate at the conclusion of the imaging steps. The softenable layer may comprise, for example, organic photoconductors in a resin, soluble photoconductive polymers, charge transfer complexes of certain aromatic resins with Lewis acids, and mixtures thereof. Typical organic photoconductors include anthracene, 2,5-bis-(p-aminophenyl)-1,3,4-oxdiazole; 2-aryl-4-arylidene-oxazolones; 4,5-diphenylimidazolidinone; 2,5-bis-(p aminophenyl)-1,3,4-triazoles; 1,3-diphenyl-tetrahydroimidazoles, 1,2,4-triazines, 1,2,5,6-tetruazacyclooctatetranes-(2,4,6,8); quinazolines; 6-hydroxy-2-phenyl-3-(p-dimethyl aminophenyl)-benzofurane; thiazolidones, triphenylamines; and mixtures thereof. Typical aromatic resins which may be sensitized with Lewis acids include: polyvinylcarbazole, epoxy resins, phenoxy resins, phenolformaldehyde resins, polystyrenes, polycarbonates, polysulfones, polyphenylene oxide and mixtures thereof. Typical Lewis acids which may be used to sensitize the above resins include 2,4,7-trinitro-9-fluorenone; 4,4-(dimethyl-amino) benzophenone; chloranil; 1,3,5-trinitrobenzene, and mixtures thereof. The above group of materials is not intended to be limiting, but merely illustrative of materials suitable for the photoconductive softenable layer. Contiguous the surface of softenable layer 12 is fracturable layer 13 comprising any suitable migration marking material. Said contiguous fracturable material may be coated upon, or slightly, partially or substantially embedded in the photoconductive softenable material at the surface of the softenable layer. "Fracturable" layer as used herein refers to any migration layer, for example migration layer forms such as Swiss cheese pattern layers, layers comprising discrete particles, and layers comprising apparently more mechanically continuous layers with a microscopic network of lines of mechanical weakness, or layers which are otherwise fracturable and not completely mechanically coherent. Such fracturable layers in the imaging system of the present invention, in response to electrical charging, imagewise exposure to activating radiation, and development are caused to selectively deposit in imagewise configuration on a suitable imaging substrate.

The layer of migration marking material 13, portions of which migrate to the substrate during image formation, may comprise any suitable conductive or insulating material or for that matter an electrically photosensitive or photoconductive material, or any photosensitively inert material. While it is preferred for images of highest resolution and density that the fracturable layer be particulate, it may comprise any continuous fracturable layer which is capable of breaking up during the development step and permitting portions to migrate to the substrate in image configuration. Typical materials include pigments, both organic and inorganic such as titanium dioxide, powdered iron, iron oxide, barium sulfate, carbon, phthalocyanine, organic materials which are capable of being formed into particles, and mixtures thereof. Where the fracturable layer comprises organic material in the form of particles, e.g., spray dried resin powders, it is necessary that the material not be entirely soluble in the solvent for the softenable layer. However, it is often desirable that the fracturable layer be slightly soluble in the solvent so that the particles reaching the substrate are at least slightly tacky and are self-fixing when the solvent is evaporated off.

The thickness of fracturable layer 13 is preferably from about 0.01 to about 2.0 microns thick, although 5 micron layers have been found to give good results for some materials.

When layer 13 comprises particles, a preferred average particle size is from about 0.01 to about 2.0 microns to yield images of optimum resolution and high density compared to migration layers having particles larger than about 2.0 microns. For optimum resultant image density the particles should not be much above about 0.7 microns in average particle size. Layers of particulate migration material preferably should have a thickness ranging from about the thickness of the smallest element of migration material in the layer to about twice the thickness of the largest element in that layer. It should be recognized that the particles may not all be packed tightly together laterally or vertically so that some of the thickness of layer 13 may constitute softenable material. The migration marking material of layer 13 may in various embodiments of the imaging member be coated onto, slightly embedded in, or substantially embedded in the softenable material of layer 12 at the upper surface of that layer. Where the migration marking material of the fracturable layer is photosensitive, the material or particles, portions of which migrate to the substrate during image formation, may comprise any suitable electrically photosensitive material which is not readily soluble in any of the media used to soften the softenable layer during development of the migration imaging member.

Electrically photosensitive particles as used herein refers to any particles which when dispersed in a softenable, nonphotoconductive electrically insulating binder or matrix layer in response to electrical charging, imagewise exposure to activating radiation, and contact with suitable softening media, are caused to selectively migrate at least in depth in the softenable material and if desired to deposit in image configuration on a substrate.

While the photoconductive particles, (and "photoconductive" is used in its broadest sense to mean particles which show increased electrical conductivity when illuminated with electromagnetic radiation and not necessarily those which have been found to be useful in xerography in xerographic pigment-binder plate configurations) have been found to be a class of particles useful as "electrically photosensitive" particles in this invention and while the photoconductive effect is often sufficient in the present invention to provide in electrically photosensitive material, it does not appear to be a necessary effect. Apparently the necessary effect according to the invention is the selective relocation of charge into, within or out of the material or particles, said relocation being effected by light acting on the bulk or surface of the electrically photosensitive material, by exposing said material or particle to activating radiation which may specifically include photoconductive effects, photo-injection, photoemission, photochemical effects and others which enhance or cause said selective relocation of charge.

The imaging process of the present invention whereby the layer structured migration imaging member having a photo-conductive softenable layer is imaged, typically comprises the steps of providing a migration force across the migration imaging member and developing the member whereby the migration marking material migrates toward the substrate in imagewise configuration. In various embodiments of migration imaging systems, the imagewise migration force may variously be an electric field acting on charged particles, a magnetic field acting on magnetic particles, a gravitational force, centrifugal force, or combinations thereof. A preferred method of providing an electrical field across the thickness of the imaging member in imagewise configuration, is providing an electrostatic latent image upon the migration imaging member. This also provides the source of the charge which becomes affixed to the particles.

Figure 3:
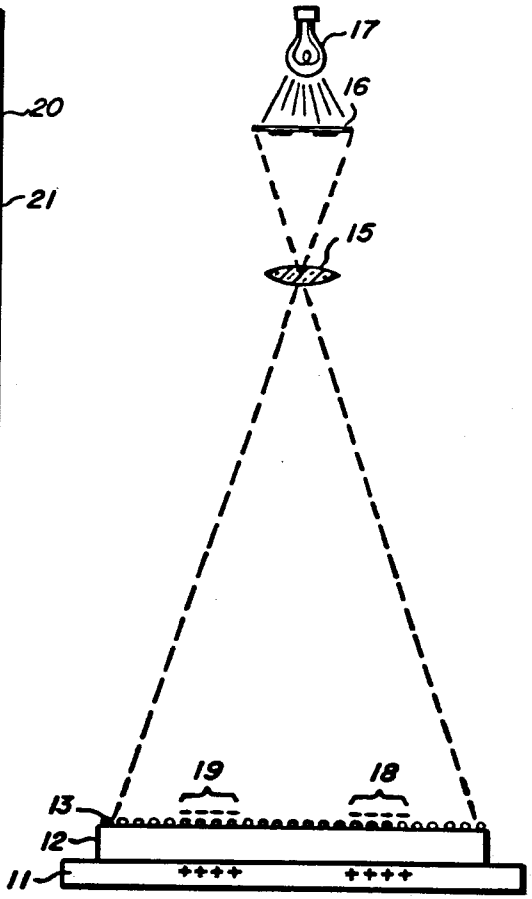
FIG. 3 shows the exposure of the member of FIG. 1 to activating electromagnetic radiation in imagewise configuration.
Figure 4:
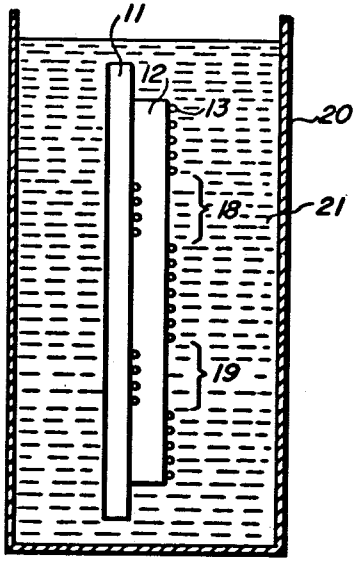
FIG. 4 shows the plate of FIG. 1 during a specific embodiment of the process of developing the latent image.
Figure 2:
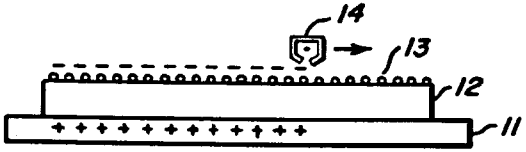
FIG. 2 shows an embodiment of electrical charging of the plate of FIG. 1.

The optimum charge-expose mode of providing an electrostatic latent image upon a migration imaging member, in conjunction with the developing step in the migration imaging process of the present invention are described in FIGS. 2, 3, and 4. In FIG. 2 the preferred migration imaging member illustrated in FIG. 1 is shown being uniformly electrostatically charged by a corona charging device 14 which deposits a uniform charge on the surface of the imaging member as it passes across the member. The substrate of the imaging member is typically electrically grounded during electric charging to enhance said charging. Typical corona charging methods are described by Walkup in U.S. Pat. No. 2,777,957 and by Carlson in U.S. Pat. No. 2,588,699. Although the process illustrated in FIG. 2 shows a uniform negative charge being deposited on the surface of the imaging member, it will also be appreciated that in various other embodiments of the imaging system, depending upon the particular combination of materials used in the imaging member and corona charging devices, either negative or positive charge may initially be placed on the surface of the imaging member. The charging illustrated in FIG. 2 is best accomplished when substrate 11 of the imaging member is substantially electrically conductive.

Where substrate 11 is an insulating material, charging of the imaging member may be accomplished by placing the insulating substrate in contact with a conductive member, and charging as illustrated in FIG. 2. Alternatively, other methods known in the art of xerography for charging xerographic plates having insulating backings may be applied. For example, the member may be charged using double-sided charging wherein a pair of corona charging devices depositing charge of opposite polarity scan in register the opposite sides of the imaging member thereby creating an electrical field between the layers of opposite electrostatic charge on the opposite surfaces of the imaging member.

After the surface of the plate is uniformly charged as illustrated in FIG. 2, it is exposed to a pattern of activating electromagnetic radiation by any suitable means for example as shown in FIG. 3. The exposure method illustrated in FIG. 3 comprises lens 15, photographic transparency 16, and a source of light 17. When the uniformly charged migration imaging member is exposed to activating radiation such as light, the photoconductive softenable layer 12 becomes conductive in the light struck areas thereby discharging in those areas. As illustrated in FIG. 3, the electrostatic charge is substantially dissipated in the light struck areas, and remains intact in the unexposed areas 18 and 19. In this way an electrostatic latent image is formed on the surface of the migration imaging member.

In various embodiments of the migration imaging system of the present invention, the migration force applying step, here electrically charging, and the exposure step may be performed simultaneously with excellent results.

As previously described, in various embodiments of the migration imaging member of the present invention, the substrate 11 may be substantially transparent. For example, members having substrates comprising aluminized Mylar or NESA glass as described above, will be substantially transparent, and are particularly suitable for use in additional modes of the imaging process. In particular, imaging members having substantially transparent substrates may be exposed in the optimum charge-expose mode of providing an electrostatic latent image on said member, by projecting the activating electromagnetic radiation onto the photoconductive softenable layer through the substantially transparent substrate 11. This process is substantially the same as the one illustrated in FIG. 3, however the imaging member having the substantially transparent substrate is upside down vis-a-vis the imaging member illustrated in FIG. 3. The effect of the activating radiation in this mode is the same, i.e., to render the photoconductive softenable layer conductive thereby dissipating the electrostatic charge in the exposed areas. Exposure through the substantially transparent substrate is particularly advantageous in processes using members having dense fracturable layers because the fracturable marking material does not interfere with imagewise exposure of the photoconductive softenable layer in this mode. The imaged members produced from imaging members having substantially transparent substrates are particularly suited for the production of transparency images such as microfilm and optical masks.

The migration imaging member having an electrostatic latent image thereon as illustrated in FIG. 3, may then be developed by softening the softenable layer 12. Softening may typically be accomplished by exposing the imaging member to liquid solvents, solvent vapors, heat, or combinations thereof. In the development step illustrated in FIG. 4, the softenable layer is shown being softened by immersing the imaging member in a bath 20 containing a solvent 21 suitable for softening softenable layer 12, but leaving substrate 11 and fracturable material 12 substantially unharmed. As layer 12 softens, the marking material in areas 18 and 19 which had retained charge after exposure, migrate in imagewise configuration to the surface of the substrate 11. While continuing immersion of the imaging member in the developing solvent, the marking material in the exposed areas remains with the softenable material of layer 12 as it dissolves and is washed away from the surface of the substrate 11. It will be appreciated that the solvent used for developing the imaging member in the illustrated mode must be sufficiently electrically insulating so that the charge remaining on the marking materials in areas 18 and 19 is not dissipated before the marking material in those areas has migrated to the surface of the substrate 11.

Where the softenable layer is to be softened and later removed by a solvent liquid, any suitable solvent which will dissolve the softenable layer without adversely affecting the fracturable layer or substrate may be used. The particular solvent chosen may depend, of course, on the particular material used for the softenable layer. Typical solvents which are suitable for use with most organic resin softenable layers include carbon tetrachloride, hexane, cyclohexane, heptane and mixtures thereof.

While the optimum electrical-optical embodiment of the imaging process of the present invention is described in detail herein, it will be clear to one skilled in the art that all of the imaging methods disclosed in copending application Ser. No. 725,676, filed May 1, 1968, and now abandoned, are suitable for use with migration imaging members having photoconductive softenable materials, and all of the imaging methods of that application are hereby expressly incorporated by reference in the present application.

Also, in the mode hereof where the imaging member comprises migration marking particles dispersed throughout a softenable photoconductive material, these members may be made and imaged using the methods of copending application Ser. No. 837,591, filed June 30, 1969 which is expressly incorporated herein by reference.

Figure 5:
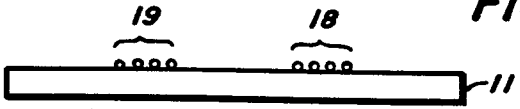
FIG. 5 shows the finally imaged plate.

The finally imaged member is illustrated in FIG. 5 for substrate 11 is shown having migration imaging material in imagewise configuration conforming to the image of the original transparency 16 on the surface of said substrate. The solvent used in the development step illustrated in FIG. 4 washed away substantially all of softenable layer 12 and the migration marking material from non-image areas. This fully developed migration imaging member is then suitable for use in any process whereby the image is fixed to the substrate, where such fixing is desirable. For example, methods of fixing migration images are disclosed in copending application Ser. No. 590,959, filed Oct. 31, 1966, and Ser. No. 695,214, filed Jan. 2, 1968.

By using solvent vapor or heat rather than solvent liquid for development, a migration image is formed which can subsequently be further developed, for example by immersion in a suitable liquid solvent. Alternatively, the image produced by vapor or heat softening development may be viewed directly. Such vapor and heat softened developed imaged members typically comprise the photoconductive softenable layer having portions of the migration marking material at least partially migrated in depth in said softenable material in imagewise configuration and having non-image portions of the fracturable layer of marking material in substantially unaltered condition contiguous the surface of the softenable layer. Where the softenable layer is imaged on a suitable substrate, the migrated in depth marking material may approach or reach the softenable layer - substrate interface or, as typically is the case, actually contact the surface of the substrate.

Figure 6:
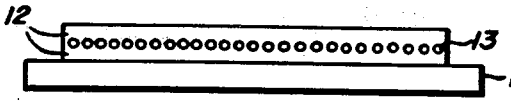
FIG. 6 shows another embodiment of the migration imaging member of the present invention.

Yet another embodiment of the migration imaging member of the advantageous system of the present invention is illustrated in FIG. 6, wherein the imaging member comprises substrate 11 having fracturable layer of migration marking material 13 sandwiched between layers of photoconductive softenable material 12. As in the previously described embodiments of the imaging member, the fracturable layer is spaced apart from the surface of substrate 11 by the intermediate photoconductive softenable layer 12. This imaging member and variations thereof is also suitable for use in the migration imaging processes described above.

The following examples further specifically define the present invention with respect to a migration imaging system employing an imaging member having a photoconductive softenable layer. The parts and percentages are by weight unless otherwise indicated. The examples below are intended to illustrate various preferred embodiments of the novel migration imaging system.

EXAMPLE I

An imagable plate is prepared by initially dissolving about 9 parts of Bakelite Resin 5254, a p-phenylphenol phenolic resin, available from Union Carbide Corporation, in a solvent blend made up of about 10 parts toluene and about 8 parts acetone. About 1 part of 2,4,7-trinitrofluorenone is added to the resin solution and the mixture is stirred until all of the materials are well dispersed. This solution is then flow coated onto a 5 mil. sheet of 1145-H19 aluminum foil, available from the Aluminum Company of America. The coated plate is forced air-dried at about 100°C. for about 5 minutes. The dry film thickness is about 8 microns. A layer of finely powdered Titanox RA-10, titanium dioxide available from Titanium Pigment Corporation, is applied onto the top surface of the resin layer by rubbing with a cotton swab until an apparently uniform particulate layer is formed. The overcoated plate is charged to a negative potential by corona discharge by the method described by Carlson in U.S. Pat. No. 2,588,699. The corona unit is maintained at about 7500 volts. The charged plate is exposed by projection with a positive black-and-white transparency with a Solar Enlarger (Burke and James Company.) A 250-watt General Electric Photoflood BBA lamp, 3400°K. color temperature, is used. Total exposure is about 200 foot-candles-seconds. The plate bearing the latent electrostatac image is immersed in a developer solvent bath consisting of carbon tetrachloride for about 30 seconds. The plate is then removed from the developer bath and dried. An excellent image corresponding to the projected image is observed on the plate. The image on the plate comprises a thin layer of titanium dioxide. The resin layer and unneeded titanium dioxide have been removed in the developer bath.

EXAMPLE II

A plate is prepared by initially dissolving about 8 parts of Bakelite Resin 5254 in a solvent blend made up of about 10 parts toluene and about 8 parts acetone. About 1 part of triphenyl amine is added to the resin solution and the mixture is stirred until all of the materials are well dispersed. The solution is coated onto an aluminum foil sheet, cured, overcoated with titanium dioxide, charged, exposed and developed as in Example I. The plate is imaged about 30 minutes after curing. A positive image of good quality is observed on the plate. A second plate is prepared as described above, and maintained at room temperature for about 6 days. The plate is then charged, exposed and developed as described above. A negative image of good quality is obtained.

EXAMPLE III

A plate is prepared as in Example II except that about 1 percent Rhodamine B Base, a xanthene dye available from Allied Chemical Company, is added to the resin solution. The thus dye-sensitized plate is prepared, charged, exposed and developed as in Example I. This plate is imaged about 1 hour after curing. It is observed that this plate develops more rapidly in the solvent bath and forms a slightly improved positive image over that produced in Example I. A second plate is prepared as described above, and maintained at room temperature for about 6 days. The plate is then charged, exposed and developed as described above. A negative image of good quality is obtained.

EXAMPLE IV

A plate is prepared by dissolving about 9 parts of Bakelite Resin 5254, about 1 part 2,5-bis-(p-aminophenyl)-1,3,4-oxa-diazole, available from Kalle and Company of Wiesbaden, Germany and about 0.1 parts of Rhodamine B Base. This resin solution is coated onto an aluminum substrate, the layer is cured, overcoated, charged, exposed and developed as in Example I. This plate is imaged about 10 minutes after curing. A positive image of good quality is obtained.

EXAMPLE V

A plate is prepared by initially dissolving about 9 parts Piccotex 100, a blend of polymerized styrenes and vinyl toluenes, available from the Pennsylvania Industrial Chemical Company in about 20 parts toluene. About 1 part of 1,3,6,8-tetranitrocarbazole is added to the resin solution and the mixture is stirred until all of the materials are well dispersed. The solution is then flow coated onto an aluminum sheet and cured. The plate is overcoated, charged, exposed and developed as in Example I. This plate is imaged about 20 minutes after curing. A positive image of good quality is obtained. A second plate is prepared as described above, and maintained at room temperature for about 6 days. The plate is then charged, exposed and developed as described above. A negative image of good quality is obtained.

EXAMPLE VI

A resin solution is prepared by dissolving about 9 parts Dow ET 693, a phenolic resin available from the Dow Chemical Company, in about 20 parts toluene. About 1 part of 2,4,7-trinitrofluorenone is added to the resin solution and the mixture is stirred until all of the materials are well dispersed. This solution is coated onto an aluminum sheet, the resin is cured, and the plate is overcoated, charged, exposed and developed as in Example I. This plate is imaged about 20 minutes after curing. A positive image of satisfactory quality is obtained.

EXAMPLE VII

A plate is prepared as in Example I above except that in place of the titanium dioxide, the resin layer is overcoated with Pure Black Iron Oxide BK-250, powdered iron oxide available from the C. K. Williams Company. The plate is charged, exposed and developed as in Example I. This plate is imaged about 30 minutes after coating and curing. A positive image, black against the aluminum substrate, of good quality is observed.

EXAMPLE VIII

A plate is prepared as in Example I except that in place of the titanium dioxide the plate is overcoated with powdered barium sulfate. Within 1 hour after the plate is prepared, the plate is charged, exposed and developed as in Example I. A positive image corresponding to the original results. A second plate is prepared as described above, and maintained at room temperature for about 6 days. The plate is then charged, exposed and developed as described above. A negative image of good quality is obtained.

EXAMPLE IX

A plate is prepared as in Example I, except that in place of the titanium dioxide the plate is overcoated with spray-dried particles of Phenoxy PKDA 8500, a phenoxy resin available from the Union Carbide Corporation. These resin particles have an average diameter of about 2 microns. About 30 minutes after the plate is prepared, it is charged, exposed, and developed as in Example I. A positive image is observed on the plate. Since the phenoxy resin has a very slight solubility in carbon tetrachloride the image adheres well to the plate when it is dried.

EXAMPLE X

A plate is prepared as in Example I except in place of the titanium dioxide, the plate is overcoated with powdered sodium phthalocyanine, available from Eastman Organic Chemical Department of Eastman Kodak Company. About 1 hour after the plate is prepared, it is charged, exposed and developed as in Example I above. A positive image conforming to the original is observed.

EXAMPLE XI

A plate is prepared as in Example I above except that in place of the titanium dioxide the plate is overcoated with powdered chloro aluminum chloro phthalocyanine, available from the Eastman Chemical Company. About 1 hour after the plate is prepared, it is charged, exposed and developed as in Example I. A positive image conforming to the original results.

EXAMPLE XII

A plate is prepared as in Example I except that in place of the titanium dioxide the plate is overcoated with a layer of powdered iron distearate available from the Witco Chemical Company. This plate is charged, exposed and developed as in Example I, except that cyclohexane is used as the developing solvent in place of carbon tetrachloride. A positive image corresponding to the original is obtained.

EXAMPLE XIII

A plate is prepared as in Example I except that in place of the aluminum substrate a sheet of carbon coated conductive paper available from Crocker, Hamilton Paper Inc. under the tradename T-62-5-16A is used. The plate in this case has a thickness of about 25 microns. The plate is charged, exposed and developed as in Example I. A positive image corresponding to the original is observed. The image appears as white areas (titanium dioxide) on a black carbon background.

EXAMPLE XIV

A plate is prepared by dissolving about 9 parts of Bakelite Resin 5254 in a solvent blend of about 10 parts toluene, and about 7 parts acetone. To this solution is added about 1 part 2,4,7-trinitrofluorenone and about 1 part Titanox RA-10. The mixture is stirred until all of the materials are well dispersed and the solution is coated onto an aluminum sheet to a thickness of about 5 microns by means of a Bird applicator, available from Bird & Sons Inc. The titanium dioxide is seen to be uniformly dispersed throughout the resin layer. The plate is charged to a negative potential by means of a corona unit maintained at about 6500 volts. The charged plate is exposed to a light and shadow pattern. Total exposure is about 250 ft/candle seconds. The plate bearing the latent electrostatic image is immersed in a developer solvent bath consisting of carbon tetrachloride for about 20 seconds. The plate is then removed from the developer bath and dried. A positive image corresponding to the original is observed on the plate. It appears that titanium dioxide in image areas migrated to the surface of the plate while the resin and titanium dioxide in non-image areas have been removed by the solvent.

EXAMPLE XV

A plate is prepared as in Example XIX except that in place of the titanium dioxide is used powdered barium sulfate. A plate is charged, exposed and developed as in Example XIX. A positive image corresponding to the original is obtained.

EXAMPLE XVI

An imaging member is prepared as in Example XIX having powdered black iron oxide dispersed therein in place of the titanium dioxide. The plate is charged, exposed and developed as in Example XIX. A positive image corresponding to the original is obtained on the imaging member.

The Examples above are specific to solvent liquid developed migration images as already described above herein. However these imaging members may just as suitably be vapor-soften or heat-soften developed.

Although specific components and proportions have been stated in the above description of the preferred embodiments of the migration imaging system employing a migration imaging member having a photoconductive softenable layer, other suitable materials and variations in the various steps in the system as listed herein, may be used with satisfactory results in various degrees of quality. In addition, other materials and steps may be added to those used herein and variations may be made in the process to synergize, enhance, or otherwise modify the properties of the invention. For example, the photoconductive softenable layer may include various spectral or electrical sensitizers and the fracturable layer may include various colorants as desired.

It will be understood that various other changes in the details, materials, steps, and arrangements of elements, which have been herein described and illustrated in order to explain the nature of the invention, will occur to and may be made by those skilled in the art, upon a reading of this disclosure, and such changes are intended to be included within the principle and scope of this invention.

What is claimed is:

1. An imaging member comprising a substrate and a fracturable layer comprising migration marking material wherein said fracturable layer is contiguous the surface of and at least partially embedded in and contacting a photoconductive insulating softenable layer comprising homogeneous photoconductive softenable material, said photoconductive insulating softenable layer material substantially devoid of fracturable layer material and said fracturable layer is overcoated with another layer of softenable material.

* * * * *